US012139680B2

(12) United States Patent
Nelson et al.

(10) Patent No.: US 12,139,680 B2
(45) Date of Patent: Nov. 12, 2024

(54) FUEL COMPOSITION WITH LUBRICITY MODIFIER

(71) Applicant: Kraton Chemical, LLC, Jacksonville, FL (US)

(72) Inventors: Lloyd A. Nelson, Savannah, GA (US); Gerald Heebner, Savannah, GA (US); Charles D. Moses, Savannah, GA (US)

(73) Assignee: KRATON CORPORATION, Houston, TX (US)

( * ) Notice: Subject to any disclaimer, the term of this patent is extended or adjusted under 35 U.S.C. 154(b) by 0 days.

(21) Appl. No.: 18/468,948

(22) Filed: Sep. 18, 2023

(65) Prior Publication Data

US 2024/0093111 A1 Mar. 21, 2024

Related U.S. Application Data

(60) Provisional application No. 63/516,709, filed on Jul. 31, 2023, provisional application No. 63/376,016, filed on Sep. 16, 2022, provisional application No. 63/376,008, filed on Sep. 16, 2022.

(51) Int. Cl.
*C10L 10/08* (2006.01)
*C10L 1/188* (2006.01)

(52) U.S. Cl.
CPC ..... *C10L 10/08* (2013.01); *C10L 1/1885* (2013.01); *C10L 2200/0446* (2013.01); *C10L 2270/026* (2013.01); *C10L 2300/20* (2013.01)

(58) Field of Classification Search
CPC ..... C10L 10/08; C10L 1/1885; C10L 2200/0446; C10L 2270/026; C10L 2300/20; C10L 1/1886; C10L 1/1888
See application file for complete search history.

(56) References Cited

U.S. PATENT DOCUMENTS 2,221,953 A * 11/1940 Read ..... C10M 1/08 585/254
6,592,639 B2 7/2003 Bernasconi et al.

* cited by examiner

*Primary Examiner* — Taiwo Oladapo

(57) ABSTRACT

The disclosure relates to fuel compositions comprising a base fuel, a lubricity modifier, and optional additives, and methods for using same. The base fuel is a middle distillate having a sulfur content of <500 ppm. The lubricity modifier comprises a plant-derived liquid decarboxylated rosin acid and optionally at least one of a fatty acid, a fatty acid derivative, and mixtures thereof. The decarboxylated rosin acid has a flash point of 95-180° C., a density of 0.9 to 1.0 g/cm3 at 20° C., a viscosity of 15 to 60 cSt at 40° C., and an acid value of <50 mg KOH/g. The fuel compositions have desired tribological properties, such as wear scar diameter, coefficient of friction, and percent film, as well as cloud point performance.

20 Claims, No Drawings

FUEL COMPOSITION WITH LUBRICITY MODIFIER

RELATED APPLICATIONS

This application claims priority to U.S. Provisional Application No. 63/376,016, filed on Sep. 16, 2022, U.S. Provisional Application No. 63/376,008, filed on Sep. 16, 2022, and U.S. Provisional Application No. 63/516,709, filed on Jul. 31, 2023, all incorporated herein by reference in their entirety.

FIELD

The disclosure relates to the use of plant-derived decarboxylated rosin acid to improve the lubricating properties of fuel compositions.

BACKGROUND

To limit the discharge of pollutant emissions, many regulations impose relatively low contents of sulfur compounds in diesel fuel (<500 ppm). Low-sulfur fuel complying with such regulations may exhibit poor lubricity leading to problems when the fuel is used. Using low-sulfur fuel in diesel engines can result in damage to fuel pumps and injectors, which rely on the natural lubricating properties of fuel to prevent component failure. Lubricity modifiers are typically added to low-sulfur diesel to increase power and driveability while enhancing acceleration, reducing emissions, and preventing hesitation.

Conventional lubricity modifiers are either fatty acids, their salts and esters, or synthetic esters of various chemical structures. There is still a need for improved environmentally friendly lubricity modifiers with good low temperature properties for use in low-sulfur diesel fuel compositions.

SUMMARY

In an aspect, a fuel composition comprising at least 80 wt. % of a base fuel, 0-5 wt. % of an additive, and 0.015-15 wt. % of a lubricity modifier is provided. The lubricity modifier comprises decarboxylated rosin acid ("DCR") and at least one of a fatty acid, a fatty acid derivative, and mixtures thereof. The DCR has a flash point of 95-180° C., according to ASTM D92, a density of 0.9 to 1.0 g/cm$^3$ at 20° C., a viscosity of 15 to 60 cSt at 40° C., according to ASTM D-445, and an acid value of <50 mg KOH/g, according to ASTM D1240-14 (2018). The base fuel is a middle distillate having a sulfur content of <500 ppm. The fuel composition exhibits a wear scar diameter of <600 μm.

In an aspect, a method of improving the lubricity of a fuel composition is provided. The method comprises adding to a base fuel 0.015-15 wt. % of a lubricity modifier comprising decarboxylated rosin acid ("DCR") and optionally at least one of a fatty acid, a fatty acid derivative, and mixtures thereof, and 0-5 wt. % of an additive. The DCR has a flash point of 95-180° C., according to ASTM D92, a density of 0.9 to 1.0 g/cm$^3$ at 20° C., a viscosity of 15 to 60 cSt at 40° C., according to ASTM D-445, and an acid value of <50 mg KOH/g, according to ASTM D1240-14 (2018). The base fuel is a middle distillate having a sulfur content of <500 ppm. The fuel composition has a wear scar diameter of <600 μm.

In an aspect, a fuel composition comprising at least 80 wt. % of a base fuel, 0-5 wt. % of an additive, and 0.015-15 wt. % of a lubricity modifier is provided. The lubricity modifier decarboxylated rosin acid and at least one of a fatty acid, a fatty acid derivative, and mixtures thereof, wherein the at least one of a fatty acid, a fatty acid derivative, and mixtures thereof is present in a weight ratio of fatty acid to decarboxylated rosin acid of 10:90 to 90:10. The DCR has a flash point of 95-180° C., according to ASTM D92, a density of 0.9 to 1.0 g/cm$^3$ at 20° C., a viscosity of 15 to 60 cSt at 40° C., according to ASTM D-445, and an acid value of <50 mg KOH/g, according to ASTM D1240-14 (2018). The base fuel is a middle distillate having a sulfur content of <500 ppm. The fuel composition exhibits a wear scar diameter of <600 μm.

DESCRIPTION

The following terms will be used throughout the specification with the following meanings unless specified otherwise.

"At least one of [a group such as A, B, and C]" or "any of [a group such as A, B, and C]," or "selected from [A, B, and C]," means a single member from the group, more than one member from the group, or a combination of members from the group. For example, at least one of A, B, and C includes, for example, A only, B only, or C only, as well as A and B, A and C, B and C; or A, B, and C, or any other all combinations of A, B, and C. In another example, at least one of A and B means A only, B only, as well as A and B.

A list of embodiments presented as "A, B, or C" is to be interpreted as including the embodiments, A only, B only, C only, "A or B," "A or C," "B or C," or "A, B, or C."

"Double Bond Equivalent" or DBE refers to a degree of unsaturation or a number of double/triple bonds present in a compound/molecule/species.

Kinematic viscosity can be measured per ASTM D445.

Thermal conductivity can be measured per ASTM D4308.

Dielectric constant can be measured per ASTM D924.

Electrical conductivity can be measured per ASTM D4308.

Dissipation Factor or Power Factor can be measured at 25° C. and 100° C. (as indicated below) per ASTM D924.

Molecular weight (MW) of compounds or components/species in a compound can be determined by MS (mass spectroscopy), preferably in combination with a chromatographic separation method like GC (gas chromatography) or HPLC (high performance liquid chromatography). In embodiments, the MW is determined by GC-MS, using a column with a highly-substituted cyanopropyl phase (e.g. Supelco SP-2330, Restek rtx-2330, or Agilent HP-88) of the size 30 m×0.25 mm×0.20 μm, with the following operating parameters: a temperature profile of 100° C. for 5.0 min, heating with 5° C./min to 250° C. and holding this temperature for 10.00 min; forming a solution with 10 mg of compound in 1 ml of a suitable solvent such as toluene, cyclohexane, etc.; injecting 1 μl of the solution with a split ratio of 1:40 at 250° C.; maintaining the flow at 1 ml/min throughout the analysis. Identification of the individual components is performed by QMS (quadrupole mass spectrometry) detector, with an ion source temperature of 200° C. and a mass range of 35-500 amu.

"Solubility Parameter" or (δ) of a solvent or polymer, refers to the square root of the vaporization energy (ΔE) divided by its molar volume (V), as in the equation $\delta=(\Delta F/V)^{1/2}$. The more similar the solubility parameters of two substances, the higher will be the solubility between them and hence the expression "like dissolves like." Hansen established that the solubility parameter of a solvent or polymer is the result of the contribution of three types of interactions: dispersion forces ($\delta D^2$), polar interactions ($\delta P^2$), and hydrogen bonds ($\delta H^2$) (Hansen, 2007; Hansen, 1967), with the total solubility (Hildebrand) parameter $\delta_T$ as the result of contribution of each of the three Hansen solubility parameters (HSP) according to: $\delta_T=(\delta 2_D+\delta 2_P+\delta 2_H)^{1/2}$.

"Middle distillate" or "middle distillate fuel" refers to any of jet fuel, diesel fuel, and the lighter grades of fuel oil, taken off the middle of a distillation column, below the light ends, such as gasoline and naphtha, and above the heavy ends and resids.

Lubricity of Diesel Fuels by High-Frequency Reciprocating Rig (HFRR) can be measured per ASTM D6079-11.

The disclosure relates to fuel compositions comprising a base fuel, a lubricity modifier, and optionally an additive, and methods for using same. The lubricity modifier comprises a plant-derived liquid decarboxylated rosin acid and optionally a fatty acid.

Lubricity Modifier: The lubricity modifier comprises, or consists essentially of, or consists of liquid decarboxylated rosin acid (DCR) and optionally at least one of a fatty acid, a fatty acid derivative, and mixtures thereof.

Decarboxylated Rosin Acid (DCR): The bio-based oil is a decarboxylated rosin acid (DCR). The DCR is a rosin-derived composition obtained by decarboxylating a rosin acid, or by dimerizing and decarboxylating a rosin acid and separating/removing the dimerized species. The DCR is in the form of a liquid, and can be any of an unhydrogenated crude, distilled or purified DCR, or hydrogenated DCR (hDCR), or mixtures thereof. Crude DCR is DCR containing 5-25 wt. % of higher molecular weight (450-1500 Da) components, e.g., hydrocarbons, oligomers, polymers, impurities, or dimer/trimer of fatty acids. Distilled or purified DCR refers to crude DCR having heavy fractions removed to improve color, reduce sulfur, etc. Hydrogenated DCR refers to DCR that has undergone hydrogenation for the reduction of C═C double bonds and obtain hydrogenated compounds. Unless specified otherwise, DCR herein refers to both unhydrogenated DCR (crude, distilled or purified), or hydrogenated DCR.

DCR is produced by the decomposition of rosin acids at high temperatures, e.g., 220-300° C. Rosin acids are normally solid, having a softening point of, e.g., 65-85° C. The rosin acid can be fully decarboxylated forming DCR. The rosin acid can be partially decarboxylated, forming DCR, which is a mixture of molecules, some of which contain monocarboxylic acids having a general molecular formula, e.g., $C_{20}H_{30}O_2$.

In embodiments, the DCR comprises one or more C═C groups, 40-100 wt. % of tricyclic species having 18-20 carbon atoms, 0-30 wt. % of components with <19 carbon atoms, and 40-100 wt. % of components with a molecular formula in the range from $C_{19}H_{20}$ to $C_{19}H_{34}$, based on the total weight of the DCR. In embodiments, sum of tricyclic species as aromatic and cycloaliphatic in the DCR is >50 wt. %, or >55 wt. %, or >60 wt. %, or >74 wt. %, or >90 wt. %, or up to 100 wt. %, of total weight of the DCR. Aromatic DCR is defined as DCR species having a MW of 252-256, with MW of 254 as having a reactive double bond, and cycloaliphatic DCR is defined as DCR species having a MW of 260 or 262.

In embodiments, the DCR has a C19 (MW 248-262) content of >50 wt. %, or >60 wt. %, or >70 wt. %, or >80 wt. %. In embodiments, the amount of cycloaliphatic DCR (MW 260 and 262) is >15 wt. %, or >20 wt. %, or >30 wt. %, or >40 wt. %, or >50 wt. %, or >80 wt. %, based on the total weight of the DCR.

In embodiments, total amount of tricyclic species having reactive double bond (C═C group) is <5 wt. %, <3 wt. %, <1 wt. %, or 0 wt. % of total weight of the DCR. Reactive C═C group is defined as DCR species having a MW of 254 or 258.

In embodiments, the DCR has C19 species with MWs of 254, 250, and 248 in an amount of <5 wt. %, or <3 wt. %, or <=1 wt. %, or <0.5 wt. %, or 0 wt. %.

In embodiments, the DCR has a C13 species with MWs of 174 and 180 in an amount of 5-20 wt. %, or 5-15 wt. %, or >5 wt. % or <20 wt. %.

In embodiments after hydrogenation, the amount of tricyclic species having 18-20 carbon atoms in the hDCR goes up to at least 70 wt. %, or 75-100, or 75-95, or 80-100, or 80-95 wt. %, based on total weight of the hDCR.

In embodiments before hydrogenation, the unhydrogenated DCR contains C19 species with a MW of 262 in an amount of 5-20 wt. %, or 5-15 wt. %, or <25 wt. %, or <20 wt. %, or <15 wt. %. After hydrogenation, the hDCR contains C19 species with a MW of 262 in an amount of 25-100 wt. %, or 25-90 wt. %, or 25-80 wt. %, or 40-75 wt. %, or 50-70 wt. %, or >25 wt. %, or >35 wt. %, or >50 wt. %, or >75 wt. %.

In embodiments before hydrogenation, the unhydrogenated DCR contains C19 species with a MW of 260 in an amount of 5-25 wt. %, or 10-20 wt. %, or >5 wt. %, or >10 wt. %, or >15 wt. %, or <20 wt. %. After hydrogenation, the hDCR contains C19 species with a MW of 260 in an amount of 0-5 wt. %, or 0-3 wt. %, or 0-1 wt. %, or <5 wt. %, or <2 wt. %, or 0 wt. %.

In embodiments before hydrogenation, the unhydrogenated DCR contains C19 species with a MW of 256 in an amount of 35-55 wt. %, or 40-50 wt. %, or >37 wt. %, or >40 wt. %, or >45 wt. %. After hydrogenation the hDCR contains C19 species with a MW of 256 in an amount of 0-40 wt. %, or 5-35 wt. %, or 10-30 wt. %, or <40 wt. %, or <30 wt. %.

In embodiments before hydrogenation, the unhydrogenated DCR contains C19 species with a MW of 252 in an amount of 5-20 wt. %, or 5-15 wt. %, >5 wt. %, or >10 wt. %. After hydrogenation, the hDCR contains C19 species with a MW of 252 in an amount of 0-5 wt. %, or 0-3 wt. %, or <5 wt. %, or <3 wt. %, or <1 wt. %, or 0 wt. %.

In embodiments before hydrogenation, the unhydrogenated DCR contains C13 species with a MW of 180 in an amount of 0-5 wt. %, or 0-3 wt. %, or <5 wt. %, or <2 wt. %, or <1 wt. %, or 0 wt. %. After hydrogenation, the hDCR contains C13 species with a MW of 180 in an amount of 0-25 wt. %, or 5-20 wt. %, or 5-15 wt. %, or >5 wt. %, or >7 wt. %, or >10 wt. %.

In embodiments before hydrogenation, the unhydrogenated DCR contains C13 species with a MW of 174 in an amount of 5-25 wt. %, 5-20 wt. %, or 5-15 wt. %, or >5 wt. %, or >10 wt. %, or <20 wt. %. After hydrogenation, the hDCR contains C13 species with a MW of 174 in an amount of 0-5 wt. %, or 0-3 wt. %, or <5 wt. %, of <2 wt. %, or 0 wt. %.

The MW of the species in unhydrogenated DCR and hDCR as measured using the analytical methods previously specified (e.g., MS, MS/GC/HPLC, and GC-MS) can be identified by the following retention profile: MW of 174 g/mol, 7.0-8.5 minutes; MW of 180 g/mol, 2.5-4.0 minutes; MW of 248 g/mol, 32.5-34.5 minutes; MW of 250 g/mol, 26.0-31.0 minutes; MW of 252 g/mol, 24.5-31.0 minutes; MW of 254 g/mol, 16.5-25.0 minutes; MW of 256 g/mol, 16.5-25.0 minutes; MW of 260 g/mol, 11.0-16.0 minutes; and MW of 262 g/mol, 11.0-16.0 minutes. For components with overlapping retention time ranges, the mass spectrum of each peak is used to identify the MW of the component. Components with the same MW (isomers) are clustered and the total amount per isomer is reported.

In embodiments, the HDCR comprises at least 5 isomers, or 10 isomers, or 20 isomers, or 50 isomers, or 100 isomers of a species having a molecular formula of $C_{19}H_{34}$ and a MW of 262 g/mol.

In embodiments after hydrogenation, the hDCR comprises C=C double bonds in amounts of <40%, or <30%, or <20%, or <15%, or <10%, or <5%, or >1%, or 1-40%, or 2-20%, or 1-10%.

In embodiments after hydrogenation, the hDCR comprises an average Double Bond Equivalent in an amount of 0.1-2, or 0.2-1.5, or 0.5-1.4, or 0.5-2, or <2, or <1.8, or <1.5, or <1.2, or >0.1.

In embodiments, DCR is characterized as having a m/z (mass/charge) value in the range of 170-280, or 220-280, or 230-270, or 234-262, or 235-265, or >230, or <265, measured by GC-FID-MS.

In embodiments, DCR is characterized as having an oxygen content of <5%, or <3%, or <2%, or <0.9%, or <0.5, or <0.2%, or <0.1%, or 0-5%, or 0-3%, or 0-2%, or 0-1%. The oxygen content (in %) can be calculated as oxygen to carbon ratio, or the sum of oxygen atoms present divided by sum of carbon atoms present, with the number of oxygen and carbon atoms being obtained from elemental analyses.

In embodiments, unhydrogenated DCR is characterized as having a lower acid value (carboxylic acid content) than the rosin acid feedstock for making the DCR. In embodiments, the DCR has an acid value of <50, or <45, or <40, or <35, or <30, or <25, or <20, or <15, or <10, or <7, or <5, or 0.5-40, or 0.5-30, or 0.5-20, or 1-20, or 1-15, or 1-15, or 1-10 mg/KOH, as measured using ASTM D1240-14 (2018) or ASTM D465.

In embodiments, hDCR has an acid value of <1, or <0.8, or <0.5, or <0.2, or 0.01-1, or 0.1-0.8, or 0.01-0.5 mg KOH/g, as measured using ASTM D1240-14 (2018) or ASTM D465.

In embodiments, DCR has a density of 0.9-1.0, or 0.91-0.99, or 0.92-0.98, or 0.93-0.97, or 0.94-0.96, or >0.9, or <1.1 g/cm$^3$.

In embodiments, DCR is characterized as having viscosities comparable to those of petrochemical base oils, due in part to its relatively high molecular weights, for example, a viscosity of 5-60, or 10-60, 15-60, or 5-55, or 10-50, or 10-45, or 15-40, or >5, or >10, or >20, or >25, or >28, or <45, or <50, or <60 cSt according to ASTM D-445, measured at 40° C.

In embodiments, unhydrogenated DCR has an aniline point of 3-40° C., or 5-40° C., or 5-30° C., or 5-25° C., or 2-20° C., or 5-20° C., or 5-15° C., or <25° C., or <20° C., or >3° C., or >5° C., or >8° C., according to ASTM D611.

In embodiments, hDCR has an aniline point of 20-80° C., 30-70° C., 30-60° C., 40-50° C., or >20° C., or >30° C., or >40° C., or <70° C., according to ASTM D611.

In embodiments, unhydrogenated DCR has a pour point of −40 to +10° C., or −35 to +8° C., −30 to +5° C., or −30 to +0° C., or −30 to −5° C., or −28 to 0° C., or −28 to −5° C., or −28 to −10° C., or >−40° C., or >−30° C., or >−28° C., or <+5° C., or <+10° C., according to ASTM D97.

In embodiments, hDCR has a pour point of −40 to −10° C., or −35 to −20° C., or −35 to −25° C., or <0° C., or <−5° C., <−10° C., or >−40° C., or >−35° C., or according to ASTM D97.

In embodiments, unhydrogenated DCR has a flash point of 135-180° C. or 135-175° C., or 135-165° C., or 135-160° C., or 140-175° C., or 140-160° C., or 140-158° C., or 140-155° C., or >135° C., or >140° C., or <175° C., or <165° C., or <160° C., according to ASTM D92.

In embodiments, hDCR has a flash point of 95-140° C., or 100-135° C., or 95-135° C., or <140° C., or <135° C., or >95° C., or >100° C., according to ASTM D92.

In embodiments, DCR has a boiling point of 200-390° C., or 210-390° C., or 235-390° C., or 280-380° C., or 290-370° C., or 300-360° C., or >290° C., or >230° C., or >210° C., or <400° C., or <370° C., measured according to D2887.

In embodiments, unhydrogenated DCR has a Gardner Color of 0-12.0, or 0.5-12.0, or 0.8-12.0, or 0.9-11, or 1.0-10.0, or 1.0-6.0, or 1.0-5, or >0, or >1.0, or >1.2, or <10.0, or <7.0, or <6.0, or <5.0, or <2.4, or <3.0, according to ASTM D6166.

In embodiments, hDCR has a Gardner Color of <1, or <0.8, or <0.5, or <0.2, or 0.1-1, or 0.15-0.8, or 0.1-0.5, according to ASTM D6166.

In embodiments, unhydrogenated DCR has a sulfur content of <500 ppm (0.05 wt. %), or <300 ppm (0.03 wt. %), or <200 ppm (0.02 wt. %), or <100 ppm (0.01 wt. %), or <10 ppm (0.001 wt. %), or 20-700 ppm (0.002-0.7 wt. %), 30-500 ppm (0.003-0.5 wt. %), or 40-400 ppm (0.004-0.4 wt. %), or 40-300 ppm (0.004-0.3 wt. %), or 40-200 ppm (0.004-0.2 wt. %), based on total weight of the DCR, measured according to ASTM D5453.

In embodiments, hDCR has a sulfur content of 0.001-10 ppm, or 0.001-5 ppm, or <10 ppm, or <8 ppm, or <5 ppm, or >0.001 ppm, measured according to ASTM D5453.

In embodiments, DCR has a VOC of <5, or <4.75, or <4.5, or <4.25, or <4.0, or <3.75, or <3.5, or <3.25, or <3.0, or <2.75, or <2.5, or <2.25, or <2.0, or <1.5, or <1.0, or <0.5 wt. %, based on total weight of the DCR. The VOC of the DCR is measured according to methods: i) summing the percent by weight contribution from all VOCs present in the product at 0.01% or more, or ii) according to the EPA (Environmental Protection Agency) method 24 or equivalent.

In embodiments, DCR has a Kb (Kauri butanol) value of 25-90, or 30-85, or 35-80, or 40-75, or 45-70, or 50-65, or >40, or >50, or >60, or >70, or >80, according to ASTM D1133.

In embodiments, DCR has a viscosity index of <−100, or <−110, or <−115, or <−120, measured according to ASTM D2270. The viscosity index is an arbitrary, unit-less measure of a fluid's change in viscosity relative to temperature change, for example, index of viscosity at 40° C. and viscosity at 100° C.

In embodiments, DCR has a 6D value of 14-18, or 14.2-17.8, or 14.5-17.5, or 15-17, or 15.2-16.5; a 6P value of 3-6, or 3.2-5.5, or 3.4-5.2, or 3.5-5.0; and 6H value of 7-10, or 7.5-9.5, or 8-9, or 8.2-8.8.

In embodiments, unhydrogenated DCR has a surface tension of 25-50, or 28-45, or 30-40 dynes/cm, according to ASTM D1331.

In embodiments, DCR has a thermal conductivity of 0.05-0.2, or 0.07-0.17, or 0.08-0.015 W/Mk, according to ASTM D4308.

In embodiments, DCR has a dielectric constant of 1-5, or 1-4, or 2-4, or 2-3, or 2.0-2.75, according to ASTM D924.

In embodiments, DCR has a specific heat capacity of 1475-1800, or 1500-1750, or 1500-1700 J/kg K, according to ASTM E1269.

In embodiments, DCR has an electrical conductivity of <3, or <2, <1, or 0.1-3, or 0.1-2, or 0.1-1 Ps/m, according to ASTM D4308.

In embodiments, DCR has a Power Factor at 25° C. of 0.001-2, 0.001-1, 0.001-0.1, or 0.005-0.05, or <2, or <1.5 or <1, or <0.5, or <0.25.

In embodiments, unhydrogenated DCR has a Power Factor at 100° C. of 1-3, or 1.5-3, or 2-2.5, or >1, or >2 or <3, according to ASTM D924.

In embodiments, hDCR has a Power Factor at 100° C. of 0.01-1, or 0.1-0.75, or <1, or >0.05, according to ASTM D924.

In embodiments, the DCR is present in the lubricity modifier in an amount of 1-99 wt. %, or 3-95 wt. %, or 5-90 wt. %, or 5-80 wt. %, or 10-75 wt. %, or 15-70 wt. %, or 25-65 wt. %, or 40-60 wt. %, or >1 wt. %, or >5 wt. %, or >10 wt. %, or <99 wt. %, or <95 wt. %, or <90 wt. %, or <85 wt. %, based on the total weight of the lubricity modifier.

In embodiments, the DCR is present in fuel compositions in an amount of <15 wt. %, or <10 wt. %, or <5 wt. %, or 0.015 to 15 wt. %, or 0.01 to 10 wt. % or 0.05 to 5 wt. %, or 0.1 to 3 wt. % based on the total weight of the fuel composition.

Fatty Acid Component: In embodiments, the DCR is used in conjunction with at least one of: a fatty acid, a fatty acid derivative (e.g., esters, amides, and salts), and mixtures thereof to form the lubricity modifier. Fatty acids are carboxylic acids with 8 to 40 carbon atoms, typically 8 to 25 carbon atoms. The fatty acids can be unsaturated or saturated, can contain one or more double carbon-carbon bonds, and can be of natural or synthetic origin. The fatty acids can also be used in dimerized and trimerized forms or blends thereof. In embodiments, the fatty acids are hydrogenated, isomerized, or purified.

Examples of carboxylic acids, or fatty acids, include lauric acid, tridecanoic acid, myristic acid, pentadecanoic acid, palmitic acid, margaric acid, stearic acid, isostearic acid, arachidic acid, behenic acid, oleic acid, erucic acid, palmitoleic acid, myristoleic acid, linoleic acid, linolenic acid, elaeosteric acid and arachidonic acid, ricinoleic acid and also fatty acid mixtures obtained from natural fats and oils, for example coconut oil fatty acid, peanut oil fatty acid, fish oil fatty acid, linseed oil fatty acid, palm oil fatty acid, rapeseed oil fatty acid, castor oil fatty acid, colza oil fatty acid, soybean oil fatty acid, sunflower oil fatty acid, and tall oil fatty acid.

In embodiments, the fatty acid is tall oil fatty acid (TOFA). TOFA can be described as a liquid mixture of unsaturated $C_{18}$ fatty acids obtained from black liquor soap, a by-product from the Kraft papermaking process. Such $C_{18}$ fatty acids are distilled from crude tall oil, an acidulated black liquor soap product from the Kraft process. Suitable TOFA may be described as a mixture of unsaturated monocarboxylic $C_{18}$ fatty acids and $C_{20}$ rosin acids (10% by weight maximum). As a non-limiting example, the primary components of tall oil fatty acids may include $C_{18:1}$ oleic and $C_{18:2}$ linoleic acids with minor amounts of unsaturated $C_{18:3}$ linoleic types, saturated $C_{16:0}$ palmitic and $C_{18:0}$ stearic acids.

In embodiments, the fatty acid is present in the lubricity modifier in a weight ratio of fatty acid to DCR of 10:90 to 90:10, or 20:80 to 80:20, or 30:70 to 70:30, or 40:60 to 60:40, or 40:60 to 50:50.

Base fuel: The base fuel may include all middle distillate fuels, e.g., jet fuel, diesel fuel, biorenewable fuels and mixtures thereof. In embodiments, the base fuel is a diesel fuel. Diesel fuels include low-sulfur diesel fuels and ultra-low-sulfur diesel fuels. In embodiments, the base fuel is a low-sulfur diesel fuel. In other embodiments, the base fuel is an ultra-low-sulfur diesel fuel. A low-sulfur diesel fuel means a fuel having a sulfur content of <500 ppm, or <400 ppm, or <300 ppm, or <200 ppm, or <100 ppm, or <50 ppm, or <40 ppm, or 30 ppm by weight on a total weight of the fuel. An ultra-low-sulfur diesel fuel (ULSD) means a fuel having a sulfur content of <20 ppm, or <15 ppm, or <10 ppm, or <5 ppm by weight based on a total weight of the fuel.

In embodiments, the base fuel comprises <30 wt. %, or <20 wt. % or 5-30 wt. %, or 10-20 wt. % of a biorenewable oil and derivatives thereof, e.g., oil derived from corn, maize, soybeans and other crops; grasses, such as switchgrass, *miscanthus*, and hybrid grasses; algae, seaweed, vegetable oils; natural fats; methyl esters; ethyl esters; methyl oleate; and mixtures thereof. In other embodiments, the base fuel is a biodiesel, a diesel fuel made from biorenewable materials, e.g., lipids (such as vegetable oils, animal fats, greases, and algae) and cellulosic material (such as crop residues, woody biomass, and dedicated energy crops), tall oil, etc.

In embodiments, the diesel fuel has a 90% point distillation temperature in the range of 300° C. to 390° C., or 330° C. to 350° C. The viscosity for these diesel fuel typically ranges from 1.3 to 24 centistokes at 40° C. The diesel fuel can be classified as any of Grade Nos. 1-D, 2-D or 4-D as specified in ASTM D975. The diesel fuel may contain esters.

In embodiments, the base fuel is present in amounts of >80 wt. %, or >85 wt. %, or >90 wt. %, or >95 wt. %, or 80-99 wt. %, or 85-99 wt. %, or 90-99 wt. %, based on the total weight of the fuel composition.

Additives: The lubricity modifier and/or fuel compositions may further comprise at least one additional additive, such as dispersants, detergents, oxygenates, antioxidants, carrier fluids, metal deactivators, dyes, markers, pour-point depressants, corrosion inhibitors, biocides, cetane improvers, antistatic additives, stabilizers, anti-foam agents, drag-reducing agents, demulsifiers, dehazers, anti-icing additives, anti-knock additives, anti-valve-seat recession additives, additional lubricity additives, combustion improvers, and mixtures thereof. Oxygenates herein can include for example and without limitation methanol, ethanol, esters, ethers, combustion improvers, and antiknock materials.

The additives can be included to the extent that they are compatible with the lubricity modifier and providing desired effects.

In embodiments, additives are added in an amount of <2 wt. %, or 0.01-2 wt. %, or 0.5-1.5 wt. %, based on the total weight of the lubricity modifier.

In embodiments, additives are added in an amount of <5 wt. %, or <3 wt. %, or <2 wt. %, or 0.01-2 wt. %, or 0.5-1.5 wt. %, based on the total weight of the fuel composition.

Properties of the Lubricity Modifier: The lubricity modifier has the advantage of being nonacidic (low acid number) which is desirable in reducing the corrosive nature of diesel fuels.

In embodiments, the lubricity modifier exhibits improved cold temperature performance by a reduction in cloud point temperature of at least 5%, or >10% or >15%, compared to a lubricity modifier only containing tall oil fatty acid by itself.

Fuel Performance Properties: Fuel compositions containing DCR show good stability and compatibility when used in the presence of other commonly used additives. The fuel compositions show improved tribological properties, such as wear scar diameter, coefficient of friction, and percent film.

In embodiments depending on the amount of DCR, cloud point of the fuel composition is from −60 to 15° C., −60 to 5° C., or −50 to 0° C., or −45 to 0° C., or −40 to −5° C.

In embodiments and depending on the amount of DCR, the fuel composition has a wear scar diameter (WSD) of less than or equal to 600 μm, or <550 μm, or <520 μm, or <500 μm, according to ASTM D6079. In embodiments, the fuel composition containing at least 2 wt. % DCR has a wear scar diameter of <450 μm, or <440 μm, or <430 μm, or <425 μm, according to ASTM D6079.

In embodiments, the fuel composition has a wear scar diameter (as measured per ASTM D6079) at least 1%, or at least 2%, or at least 5%, or at least 10%, or at least 15%, or at least 20% smaller than wear scar diameter of ultra-low-sulfur diesel alone or an ultra-low-sulfur diesel with methyl oleate as a lubricity modifier.

In embodiments, the fuel composition has a coefficient of friction (CoF), as measured per ASTM D6079, at least 1%, or at least 2%, or at least 5%, or at least 10%, or at least 15%, or at least 20% smaller than the CoF of ultra-low-sulfur diesel alone, or an ultra-low-sulfur diesel with methyl oleate as a lubricity modifier.

In embodiments, the fuel composition has an increase in percent film (as measured per ASTM D6079) of at least 1%, or at least 2%, or at least 5%, or at least 10%, or at least 15%, or at least 20% than the percent film of ultra-low-sulfur diesel alone, or DCR alone.

Applications and Methods for Use: The lubricity modifier can be used in middle distillate fuel compositions, such as jet fuel, low-sulfur diesel, ultra-low-sulfur diesel, etc. The fuel compositions may be applicable to the operation of engines, such as stationary engines (e.g., engines used in electrical power generation installations, in pumping stations, etc.) and ambulatory engines (e.g., engines used as prime movers in automobiles, trucks, road-grading equipment, military vehicles, etc.).

Depending on the middle distillate base fuel employed, the components can be mixed at the same time, or in certain sequences, forming a fuel composition. The lubricity modifier may be added to the base fuel at the refinery or at any stage of subsequent storage, shipment (such as pipeline), or delivery (such as pump stations). In embodiments, the lubricity modifier is manufactured as an after-market lubricity modifier/anti-wear additive and then added to a base fuel.

In embodiments, the lubricity modifier is used as a component in forming preformed additive combinations and/or sub-combinations as additive packages. Additive packages can include a variety of components and are tailored for intended end use and/or function. Examples of additive packages include solvents, biocides, detergents, corrosive inhibitors, cetane improvers, dyes, and antistatic compounds.

Improvements in vehicle fuel economy benefits and longer engine service lifetimes are expected with the fuel composition containing DCR. Another benefit such as reduced pollution, as measured by hydrocarbon, carbon monoxide, and $NO_x$, emissions, is also expected.

Examples: The components used in the examples are as follows.

DCR samples are from Kraton Corporation and have properties as shown in Table 1. The DCR samples also have the followings for DCR 1, DCR 2, DCR 3, and DCR 4 respectively: aromatic MW252 of 15.7, 14.0, 4, and 4.1; reactive double bond MW 254 of 0.1, 0.5, 16, and 17.1; aromatic MW256 of 40.3, 45.3, 36, and 38.8; and cycloaliphatic MW260 of 0.7, 0.3, 31.4, and 31.8; reactive double bond MW 258 of 0.4, 0.8, 4.5, and 3.8; % $O_2$ content of 0.39 and 0.1 and % tricyclic species of 69.5 and 77.7 (for DCR 1 and DCR2, respectively). DCR 1, DCR 2, DCR 3 and DCR 4 are unhydrogenated.

TABLE 1

| | DCR Samples | | | |
|---|---|---|---|---|
| | DCR 1 | DCR 2 | DCR 3 | DCR 4 |
| Acid Number (mg KOH/g) | 7 | 2 | 4.5 | 2.3 |
| Color | — | 1 | 9.8 | 3.4 |
| Viscosity, cSt @ 40° C. | 45.3 | 25.2 | 39.3 | 32.8 |
| Density, @ 40° C. | 0.95 | 0.95 | 0.94 | 0.962 |
| Sulfur (ppm) | 274 | 66 | 419 | 187 |
| Flash Point, COC | 140 | 141 | n/a | 158 |
| Aniline Point | 14 | 13 | 14 | 15 |
| Pour Point | −14 | −26 | −18 | −24 |

TOFA 1 is a tall oil fatty acid from Kraton Corp., having an acid number of 194, a Gardner color of 4.5, a rosin acids content of 2.5%, an iodine number of 125 and unsaponifiables of 2.2.

Estolide is made from TOFA 1 by adding sulfuric acid and heating to 85° C. (top temperature) over a 24-hour time period, increasing the temperature 10° C. every five hours to achieve an acid number of 153 mg/g.

Methyl oleate is a fatty acid methyl ester with an acid value of <4, an iodine value of 75-90, a Gardner color of <6.

Naphthenic is a naphthenic base oil with a viscosity of 20.40 cSt at 40° C., a flashpoint of 166° C., an aniline point of 79.6° C.

Ultra-low-sulfur diesel (ULSD) with a sulfur content of about 8 ppm.

Lubricity modifier samples were prepared using TOFA and/or DCR. The samples with two components were mixed at room temperature until combined. Samples of the lubricity modifier (as described in Table 2) were then subjected to cold temperature property tests (ASTM D2500). The results of the cold temperature property tests are shown in Table 2 below.

TABLE 2

| | Cloud Point, ° C. | Δ Cloud Point |
|---|---|---|
| DCR 2 | ND* | |
| TOFA 1 | 2.8 | 0 |
| TOFA 1:DCR 2 ratio 9:1 | 0.6 | −2.2 |
| TOFA 1:DCR 2 ratio 8:2 | −1.6 | −2.2 |
| TOFA 1:DCR 2 ratio 7:3 | −5 | −3.4 |
| TOFA 1:DCR 2 ratio 6:4 | −7.5 | −2.5 |
| TOFA 1:DCR 2 ratio 5:5 | −11.1 | −3.6 |
| TOFA 1:DCR 2 ratio 4:6 | −17.2 | −6.1 |
| TOFA 1:DCR 2 ratio 3:7 | −24.2 | −7 |

*ND, not detected to −55° C.

Example compositions A-F were prepared using ultra low-sulfur diesel as the base fuel with the lubricity modifier as indicated Table 3. Example composition A is ultra-low-sulfur diesel alone as a control. Example compositions B-F contain 0.015 wt. % (150 ppm) and example compositions G-L contain 2 wt. % (20,000 ppm) of the identified lubricity modifier in ultra-low-sulfur diesel as the base fuel. The samples were mixed at room temperature until combined.

The example compositions were subjected to a high frequency reciprocating rig test (ASTM D6079). The results of the HRFF test are shown in Table 3 below.

TABLE 3

| | A | B | C | D1 | D2 | E | F |
|---|---|---|---|---|---|---|---|
| Base fuel | | | | balance to = 100% | | | |
| ULSD (control) | 100 | — | — | — | — | — | — |
| DCR 1 | — | 0.015 | — | — | — | — | — |
| DCR 2 | — | — | 0.015 | — | — | — | — |
| TOFA 1 | — | — | — | 0.015 | — | — | — |
| TOFA 1 and DCR 1 (ratio of 1:1) | — | — | — | — | 0.015 | — | — |
| TOFA 1 and estolide (ratio of 1:1) | — | — | — | — | — | 0.015 | — |
| Methyl Oleate | — | — | — | — | — | — | 0.015 |
| Percent Film | 8 | 8 | 11 | 45 | 30 | 32 | 8 |
| Coefficient of Friction | 0.354 | 0.418 | 0.337 | 0.191 | 0.209 | 0.209 | 0.367 |
| Wear Scar Diameter, μm | 531 | 580 | 527 | 408 | 426 | 427 | 555 |

| | G | H | I | J | K | L |
|---|---|---|---|---|---|---|
| Base fuel | | | balance to = 100% wt. % | | | |
| DCR 1 | 2 | — | — | — | — | — |
| DCR 2 | — | 2 | — | — | — | — |
| Methyl Oleate | — | — | 2 | — | — | — |
| Naphthenic | — | — | — | 2 | — | — |
| DCR 3 | — | — | — | — | 2 | — |
| DCR 4 | — | — | — | — | — | 2 |
| Percent Film (%) | 55 | 46 | 46 | 11 | 40 | 43 |
| Coefficient of Friction | 0.140 | 0.191 | 0.180 | 0.324 | 0.169 | 0.193 |
| Wear Scar Diameter, μm | 394 | 402 | 426 | 529 | 400 | 420 |

Example compositions 1-8 were prepared using ultra low-sulfur diesel (ULSD) as the base fuel with the lubricity modifier as indicated Table 4. Example composition 1 is ULSD alone as a control. Example composition 2-8 contain 0.015 wt. % (150 ppm) of the identified lubricity modifier in ultra-low-sulfur diesel as the base fuel. The samples were mixed at room temperature until combined.

The samples were subjected to a high frequency reciprocating rig test (ASTM D6079). The results of the HRFF test are shown in Table 4 below.

TABLE 4

| Example | | Film, % | Coefficient of Friction | WSD, μm |
|---|---|---|---|---|
| 1 | ULSD | 24 | 0.482 | 579 |
| 2 | TOFA 1:DCR 2 ratio 9:1 | 38 | 0.200 | 425 |
| 3 | TOFA 1:DCR 2 ratio 8:2 | 37 | 0.204 | 434 |
| 4 | TOFA 1:DCR 2 ratio 7:3 | 30 | 0.213 | 443 |
| 5 | TOFA 1:DCR 2 ratio 6:4 | 36 | 0.206 | 434 |
| 6 | TOFA 1:DCR 2 ratio 5:5 | 31 | 0.213 | 433 |
| 7 | TOFA 1:DCR 2 ratio 4:6 | 24 | 0.240 | 475 |
| 8 | TOFA 1:DCR 2 ratio 3:7 | 19 | 0.283 | 517 |

As used herein, the term "comprising" means including elements or steps that are identified following that term, but any such elements or steps are not exhaustive, and an embodiment can include other elements or steps. Although the terms "comprising" and "including" have been used herein to describe various aspects, the terms "consisting essentially of" and "consisting of" can be used in place of "comprising" and "including" to provide for more specific aspects of the disclosure and are also disclosed.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

Unless otherwise specified, all technical and scientific terms used herein have the same meanings as commonly understood by one of skill in the art to which the disclosed disclosure belongs. The recitation of a genus of elements, materials or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A fuel composition comprising:

at least 80 wt. % of a base fuel, the base fuel is a middle distillate having a sulfur content of <500 ppm;

0-5 wt. % of an additive;

0.015-15 wt. % of a lubricity modifier comprising a decarboxylated rosin acid and optionally at least one of a fatty acid, a fatty acid derivative, and mixtures thereof;

wherein the decarboxylated rosin acid has:

a flash point of 95-180° C., according to ASTM D92 a density of 0.9 to 1.0 g/cm$^3$ at 20° C.;

a viscosity of 15 to 60 cSt at 40° C., according to ASTM D-445; and an acid value of <50 mg KOH/g, according to ASTM D1240-14 (2018);

wherein the fuel composition exhibits a wear scar diameter of less than or equal to 600 μm, according to ASTM-D6079.

2. The fuel composition of claim 1, wherein the decarboxylated rosin acid comprises one or more C=C groups, and 40-100 wt. % of tricyclic species having 18-20 carbon atoms.

3. The fuel composition of claim 2, wherein sum of tricyclic species as aromatic and cycloaliphatic in the decarboxylated rosin acid is >50 wt. %, based on total weight of the decarboxylated rosin acid.

4. The fuel composition of claim 3, wherein amount of the tricyclic cycloaliphatic species in the decarboxylated rosin acid is >15 wt. %, based on total weight of the decarboxylated rosin acid.

5. The fuel composition of claim 1, wherein the decarboxylated rosin acid has at least one of:

an aniline point of 3-40° C., according to ASTM D611;

a pour point of −40 to +10° C., according to ASTM D97;

a flash point of 95-175° C., according to ASTM D92;

a boiling point of 200-390° C., according to D2887;

a Gardner Color of 0-12.0, according to ASTM D6166;

a sulfur content of <500 ppm, according to ASTM D5453;

a Kb (Kauri butanol) value of 25-90, according to ASTM D1133;

a viscosity index of <−100, according to ASTM D2270;

a viscosity of 20-50 cSt, according to ASTM D-445 at 40° C.;

a thermal conductivity of about <0.3, according to ASTM D4308;

a dielectric constant of <5, according to ASTM D924;

a specific heat capacity of 1475-1800, according to ASTM E1269;

an electrical conductivity of <3 Ps/m, according to ASTM D4308; and a Power Factor at 100° C. of 0.01-3, according to ASTM D924.

6. The fuel composition of claim 1, wherein the decarboxylated rosin acid is unhydrogenated, and wherein the unhydrogenated decarboxylated rosin acid has at least one of:

a C19 species with a MW of 262 in an amount of 5-20 wt. %;

a C19 species with a MW of 260 in an amount of 5-25 wt. %;

a C19 species with a MW of 256 in an amount of 35-55 wt. %;

a C19 species with a MW of 252 in an amount of 5-20 wt. %;

a C13 species with a MW of 180 in an amount of 0-5 wt. %; and a C13 species with a MW of 174 in an amount of 5-25 wt. %.

7. The fuel composition of claim 1, wherein the middle distillate is a low-sulfur diesel fuel or an ultra-low-sulfur diesel fuel.

8. The fuel composition of claim 1, wherein the at least one of a fatty acid, a fatty acid derivative, and mixtures thereof is a tall oil fatty acid.

9. The fuel composition of claim 1, wherein the at least one of a fatty acid, a fatty acid derivative, and mixtures thereof is present in the fuel composition in a weight ratio of fatty acid to decarboxylated rosin acid of 10:90 to 90:10.

10. The fuel composition of claim 1, wherein the lubricity modifier has a reduction in cloud point temperature of at least 5% compared to a lubricity modifier containing fatty acid alone.

11. The fuel composition of claim 1, wherein the base fuel has a sulfur content of <50 ppm, based on the total weight of the fuel composition.

12. A method of improving lubricity of a fuel, the method comprising:

adding to a base fuel: (a) 0.015-15 wt. % of a lubricity modifier comprising decarboxylated rosin acid and optionally at least one of a fatty acid, a fatty acid derivative, and mixtures thereof, and (b) 0-5 wt. % of an additive, forming a fuel composition;

wherein the decarboxylated rosin acid has:

a flash point of 95-180° C., according to ASTM D92 a density of 0.9 to 1.0 g/cm$^3$ at 20° C.;

a viscosity of 15 to 60 cSt at 40° C., according to ASTM D-445; and an acid value of <50 mg KOH/g, according to ASTM D1240-14 (2018);

wherein the base fuel is a middle distillate having a sulfur content of <500 ppm;

wherein the fuel composition has a wear scar diameter of <600 μm, according to ASTM-D6079.

13. The method of claim 12, wherein the decarboxylated rosin acid comprises one or more C=C groups, and 40-100 wt. % of tricyclic species having 18-20 carbon atoms, based on the total weight of the decarboxylated rosin acid.

14. The method of claim 13, wherein sum of tricyclic species as aromatic and cycloaliphatic in the decarboxylated rosin acid is >50 wt. %, based on total weight of the decarboxylated rosin acid.

15. The method of claim 14, wherein amount of the tricyclic cycloaliphatic species in the decarboxylated rosin acid is >15 wt. %, based on total weight of the decarboxylated rosin acid.

16. A fuel composition comprising:

at least 80 wt. % of a base fuel;

0-5 wt. % of an additive;

0.015-15 wt. % of a lubricity modifier comprising decarboxylated rosin acid and at least one of a fatty acid, a fatty acid derivative, and mixtures thereof, wherein the at least one of a fatty acid, a fatty acid derivative, and mixtures thereof is present in a weight ratio of fatty acid to decarboxylated rosin acid of 10:90 to 90:10;

wherein the decarboxylated rosin acid has:

a flash point of 95-180° C., according to ASTM D92 a density of 0.9 to 1.0 g/cm$^3$ at 20° C.;

a viscosity of 15 to 60 cSt at 40° C., according to ASTM D-445; and an acid value of <50 mg KOH/g, according to ASTM D1240-14 (2018);

wherein the base fuel is a middle distillate having a sulfur content of <500 ppm;

wherein the fuel composition exhibits a wear scar diameter of <550 μm, according to ASTM-D6079.

17. The fuel composition of claim 16, wherein the fuel composition has a cloud point of less than 5° C., according to ASTM D2500.

18. The fuel composition of claim 16, wherein the decarboxylated rosin acid comprises one or more C=C groups, and 40-100 wt. % of tricyclic species having 18-20 carbon atoms, based on the total weight of the decarboxylated rosin acid.

19. The fuel composition of claim 18, wherein sum of tricyclic species as aromatic and cycloaliphatic in the decarboxylated rosin acid is >50 wt. %, based on total weight of the decarboxylated rosin acid.

20. The fuel composition of claim 19, wherein amount of the tricyclic cycloaliphatic species in the decarboxylated rosin acid is >15 wt. %, based on total weight of the decarboxylated rosin acid.

* * * * *